US005183255A

United States Patent [19]

Antonious

[11] Patent Number: 5,183,255

[45] Date of Patent: Feb. 2, 1993

[54] GOLF CLUB WITH IMPROVED HOSEL CONSTRUCTION

[76] Inventor: Anthony J. Antonious, 7738 Calle Facil, Sarasota, Fla. 34238

[21] Appl. No.: 739,089

[22] Filed: Aug. 1, 1991

Related U.S. Application Data

[63] Continuation of Ser. No. 732,088, Jul. 18, 1991, abandoned.

[51] Int. Cl.[5] ..... A63B 53/04

[52] U.S. Cl. ..... 273/167 G; 273/167 J

[58] Field of Search ..... 273/80 R, 80 C, 80.2, 273/80.5, 167 A, 167 G, 167 J, 167 F, 164

[56] References Cited

U.S. PATENT DOCUMENTS

| | | | |
|---|---|---|---|
| D. 302,715 | 8/1989 | Peterson | D21/220 |
| 1,550,501 | 8/1925 | Byrne | 273/167 G |
| 1,574,915 | 3/1926 | Marston | 273/164 |
| 2,231,847 | 2/1941 | Dickson et al. | 273/80 C |
| 2,683,036 | 7/1954 | Klein | 273/80 |
| 3,947,041 | 3/1976 | Barber | 273/167 G |
| 3,995,865 | 12/1976 | Cochran et al. | 273/167 F |
| 4,211,416 | 7/1980 | Swanson | 273/164 |
| 4,345,763 | 8/1982 | Swanson | 273/164 |

FOREIGN PATENT DOCUMENTS

| | | | |
|---|---|---|---|
| 6682 | of 1891 | United Kingdom | 273/80 C |

*Primary Examiner*—William H. Grieb
*Assistant Examiner*—Steven B. Wong
*Attorney, Agent, or Firm*—Nicholas J. Aquilino

[57] ABSTRACT

An iron type golf club head with an improved hosel construction wherein the hosel is positioned behind the ball striking face adjacent the heel; the ball striking face is planar from the toe to the heel; and the centerline of the hosel intersects with the extended plane of the ball striking face at a point proximate the club head's center of gravity and above the lower quadrant of the club head.

17 Claims, 5 Drawing Sheets

GOLF CLUB WITH IMPROVED HOSEL CONSTRUCTION

RELATED APPLICATIONS

This application is a continuation of Ser. No. 07/732,088 filed Jul. 18, 1991, now abandoned, for Golf Club With Improved Hosel Construction.

BACKGROUND AND DESCRIPTION OF THE INVENTION

The present invention relates to golf club irons and, in particular, to an improved hosel construction wherein the hosel is positioned rearwardly of the leading edge of the ball striking face.

Conventional golf club irons include a hosel connected at the heel end of the club head which attaches the shaft to the head. The relationship between the centerline of the hosel, or shaft hole, and the furthest portion, or leading edge, of the golf club face is defined as face progression. See *Golf Club Design Fitting Alteration and Repair* by Roger Maltby, one of the most respected and accepted manuals in the golf industry covering practically all aspects of golf clubs. For the purpose of this application, when the leading edge of the club face is behind the hosel centerline, golf clubs have rearward face progression. When the centerline of the hosel is in line with the leading edge of the ball striking face, the club head has zero face progression. When the leading edge of the club face is in front of the centerline of the hosel, the club head has forward face progression. Normally, the hosel of a conventional golf club is formed with either zero face progression or rearward face progression, creating what is known as an "offset" between the club face and the hosel. Traditional golf club sets, using this principle, have progressive rearward face progression in accordance with the loft of the individual irons. With these designs, the hosel lies in front of the ball striking face, forming a bridge between the hosel and the angled club face. As a result, when the club face is swung outside the intended swing plane line through the center of the ball, the ball is often struck on the bridge between the hosel and club face or directly on the protruding base of the hosel itself, producing what is known in the game of golf as a "shanked shot."

The prior art shows various attempts at making shankless golf club heads, including the U.S. Pat. Nos. to Byrne (1,550,501), Klein (2,683,036), Barber (3,947,041), and Peterson (Des. 302,715), among others.

The Byrne patent (1,550,501) shows a golf club wherein the hosel is located completely behind the ball striking face, producing a golf club head where the ball striking face is entirely ahead of the shaft centerline. The shaft connects to the hosel above the club head body.

The Klein patent (2,683,036) also discloses a non-shanking golfing iron where the center line of the hosel is located well behind or wholly to the rear of the ball striking face, and the shaft connects to the hosel above the club head body.

The Barber patent (3,947,041) shows a shankless iron wherein an extension of the centerline of the club shaft intersects the plane defined by the club face in the lower quadrant. The shaft extends into the hosel only at a depth which connects with the club head at a point above the club head body.

Finally, the design patent to Peterson (Des. 302,715) shows only a low-lofted iron wherein the hosel connection is a direct extension of the ball striking face. As shown in FIG. 3, the centerline of the shaft does not intersect the loft plane of the club face, and the shaft extends into the hosel above the club head body.

SUMMARY OF THE INVENTION

The present invention provides a non-shanking golf club iron having forward face progression wherein shanking is eliminated by placing the leading edge of the ball striking face in front of the centerline of the hosel so it intersects with an extended loft plane of the club face at the upper half or central portion of the club face, preferably at a point proximate the club head's center of gravity. The golf club further includes a ball striking face which is planar from the toe to the heel, eliminating a bridge or protruding portion of the hosel forward of the ball striking face. Another feature locates the end of the shaft socket below the top ridge of the club head, more preferably below the lowest point of the top ridge. Such an arrangement provides a club head with increased structural integrity, while eliminating one of the more feared shots in golf, "the shank." In addition, the trailing or rear edge of the sole of the club head is substantially parallel, and preferably precisely parallel, to the leading edge of the sole and the club face, along substantially the entire length of the club head. The sole of the club head therefore has approximately an equal width along its length that is in normal contact with the ground surface at address. The trailing edge of the sole is preferably in substantial alignment with the rear portion of the hosel, providing a smooth progression of this portion of the soles' rear edge into the hosel. Such a club head has increased mass at the heel portion and additional structural integrity and strength at the heel area. As a result, balls which are "shanked" or mis-hit in the heel area with traditional clubs are hit straight and more solidly with the present invention. In addition, the parallel trailing edge of the club head can be visually manipulated so that it is perpendicular to the intended line of flight and provides the golfer with a sight line reference which enables the golfer to more accurately align the leading edge of the club face with the intended line of flight.

Among the objects of the present invention is the provision of an improved iron type golf club head in which the possibility and fear of shanking is minimized or eliminated, and the club head's structural and functional characteristics are substantially improved. Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention provides an iron-type golf club head having a center of gravity and including a hosel, a heel, a toe, a bottom sole, a leading edge, a trailing rear edge, a top ridge, and a ball striking face, wherein the improvement positions the hosel centerline behind the leading edge of the ball striking face creating a golf club with forward face progression whereby the centerline of the hosel intersects an extended loft plane of the ball striking face at a point proximate the club head's center of gravity and above the lower quadrant of the ball striking face of the club head and provides a ball striking face which is planar from the toe to the heel.

It is to be understood that both the foregoing general description and the following detailed description are exemplary and explanatory only and are not restrictive of the invention, as claimed.

The accompanying drawings, which are incorporated in and constitute a part of this specification, illustrate the invention and together with the description, serve to explain the principles of the invention.

DESCRIPTION OF PREFERRED EMBODIMENTS

Figure 1:
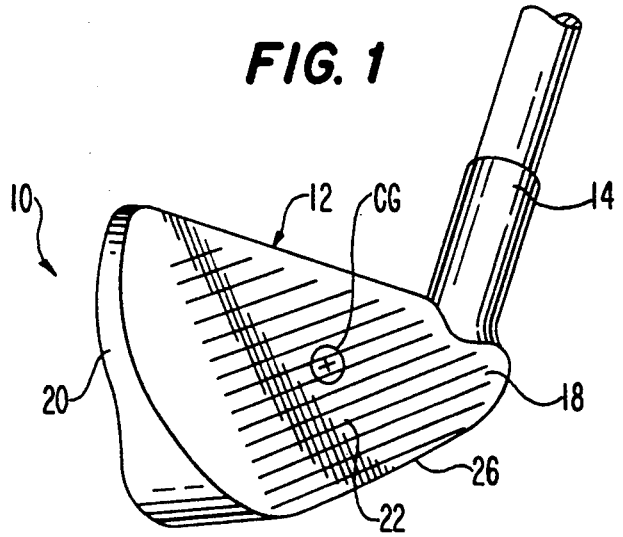
FIG. 1 shows a front perspective view of the shankless golf club head of the present invention.

Reference will now be made in detail to the present preferred embodiments of the invention, examples of which are illustrated in the accompanying drawings. Wherever possible, the same reference numbers will be used throughout the drawings to refer to the same or like parts.

The present invention relates to iron type golf club heads, and more particularly, to iron type golf club heads having forward face progression wherein the leading edge of the ball striking face is formed in front of or forward of a centerline of the hosel. Most iron type golf club heads are constructed with rearward face progression, that is wherein the ball striking face is behind the centerline of the hosel, creating an offset. Whereas this traditional design has been the most used by many golfers, these golf clubs have an inherent defect in that the hosel and the bridge member between the hosel and the ball striking face extend forward of the ball striking face. This creates a possibility of hitting a "shanked shot" should the club face be swung outside or in front of the proper swing plane, causing a portion of the hosel to contact the ball.

With the present invention, the hosel centerline is behind the leading edge of the ball striking face so that the iron club head is provided with forward face progression which eliminates the possibility of the shot being "shanked" if the ball is struck toward the heel on the club face. The hosel centerline intersects the extended loft plane of the club face in the middle area or upper half of the club face preferably proximate the club head's center of gravity. The club head is preferably designed so that its center of gravity is above a longitudinal midline drawn through the striking face. In one preferred embodiment, the irons are designed so that a plane parallel to the leading edge and extending through the hosel centerline intersects the ball striking face at a point 1¼ inches along the striking face upwardly from the leading edge of the club face on each of the irons in the set. In another preferred embodiment, the irons are designed so that this plane intersects within 0.250 inches below or above the center of gravity on each of the irons in the set. Both of these arrangements virtually eliminate any possibility of shanking the iron due to a faulty golf swing which positions the club face outside or in front of the normal swing plane through the center of the ball when contact is made.

Another feature which adds to the stability of the golf club head of the present invention lies in the location of the hosel cavity or socket. The hosel socket extends below the highest point of the top ridge of the club head and preferably extends to the point below the lowest point of the top ridge. More preferably, the hosel cavity extends below the center of gravity of the club head. In one embodiment, it extends within 0.250 inches from the sole. These arrangements permit the shaft to be inserted within the hosel so that the lower end of the shaft is well below the top ridge of the club head, and more in-line with and closer to the center of gravity of the club head for providing greater strength and stability.

With the club head of the present invention, a golfer may make a swing without the fear of striking the ball on the hosel, where it will produce a shank, causing it to deflect in a sideways direction from the intended line of flight. With the present structure, any golf ball struck toward the heel portion of the club head will fly toward the target with a force and trajectory only slightly variant from a golf ball struck directly on the center of percussion. The elimination of striking the ball at the shank causing area, for those golfers who are inclined to do so, will increase their confidence level to a point where better overall golf ball-contacting swings can be quickly developed and easily repeated, thereby measurably improving the game of the player.

Figure 2:
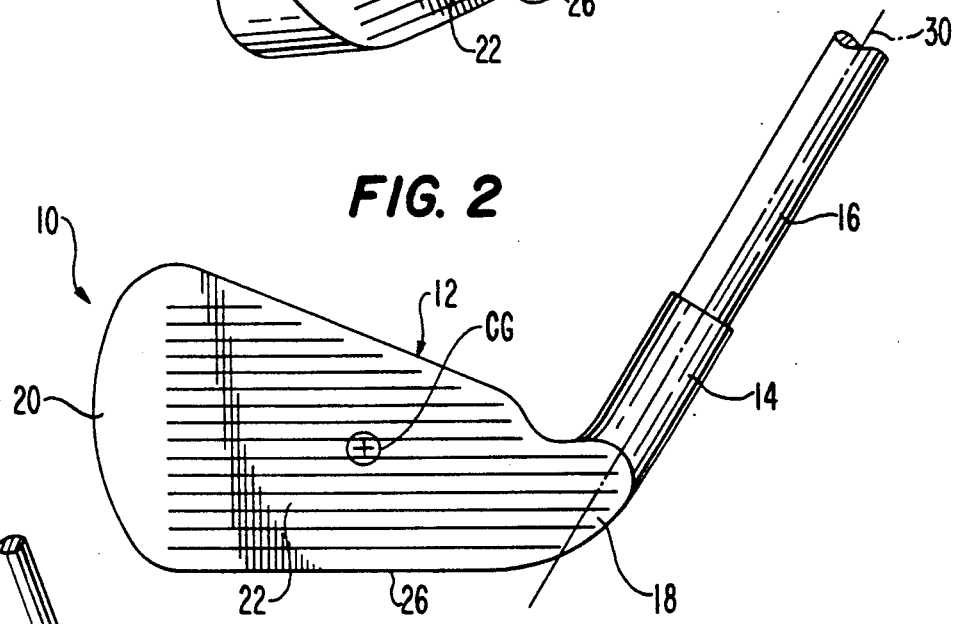
FIG. 2 shows a front elevational view thereof.
Figure 3:
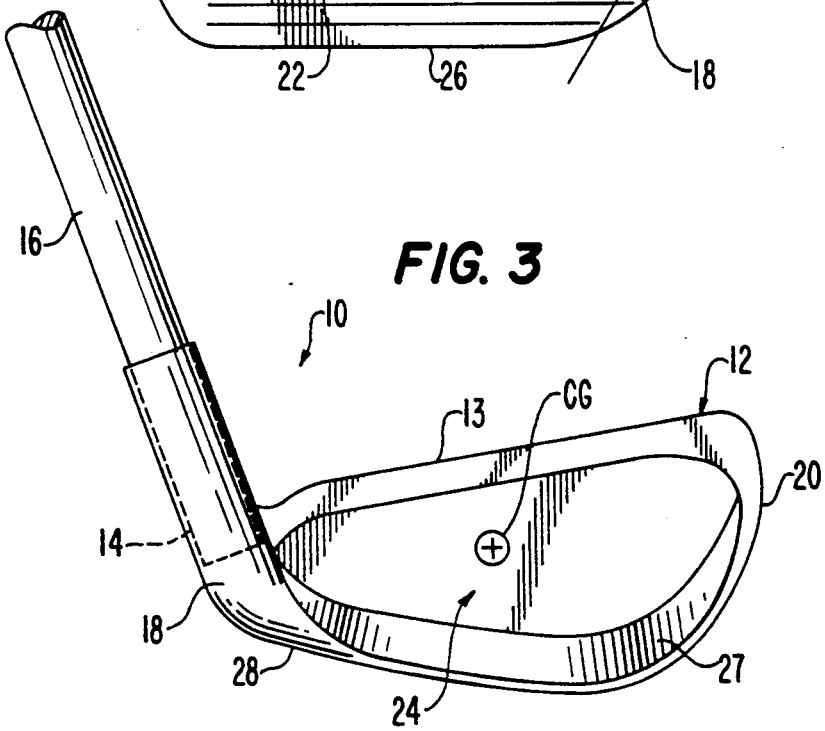
FIG. 3 shows a rear elevational view thereof.
Figure 5:
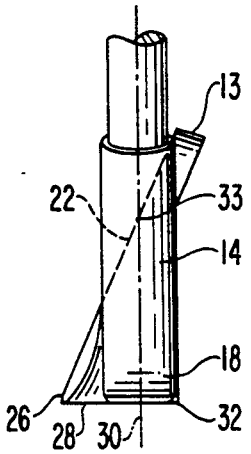
FIG. 5 shows an end elevational view taken from the hosel end of the golf club.
Figure 4:
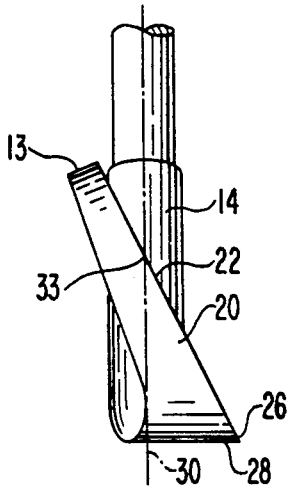
FIG. 4 shows a end elevational view taken from the toe end of the golf club.

Referring to the drawings, FIGS. 1–5 show a typical cavity back weighted golf club head (10) in accordance with the present invention, including a club head body (12), a hosel (14), shaft (16), heel (18), toe (20), ball striking face (22) having a center of gravity (C.G.) approximately in the middle of the ball striking face, and a sole (28). The hosel (14) includes a centerline (30) as best seen in FIGS. 2, 4 and 5 extending along the longitudinal axis thereof.

The club head includes a rear cavity (24), defined by a peripheral weight (27), although it will be appreciated that the present invention is equally applicable to non-cavity back designs, including forged heads and muscle back heads. The forward most portion of the ball striking face (22), is defined as the leading edge (26) and which also coincides with the forward most portion of the sole (28). The club head includes a trailing edge (32) at the rearward portion of the sole (28).

Referring to FIG. 2, the entire ball striking face (22) of the club head (10) is planar, from the toe (20) to the heel (18). There is no disruption between the hosel (14) and the main portion of the club face (22) and the extended ball striking face (22) of the club head at the hosel (14) is preferably positioned and shaped forward of the hosel to effectively strike a golf ball hit in this area. As can be seen from the drawing, the lowermost portion of the hosel (14) of the club head (10) is at an extreme rear lower corner of the club head (10) adjacent the point where the heel (18) and the sole (28) interface. Viewing the club head (10) in the front elevational view of FIG. 2, the connection point between the hosel (14) and the club head body (12) is at the lower right-hand portion thereof and behind the ball striking face (22), while maintaining the center line of the hosel (14) through an extended loft plane of the ball striking face (22) at an intersection point (33) proximate the club's center of gravity (C.G.).

Another feature of the improved iron type golf club head of the present invention can be seen with reference to FIG. 3, the lower portion of the hosel (14) extends to interface with the sole (28) at the heel (18) whereby the shaft (16) extends within the hosel (14) to a point at or below the top ridge (13) of the club head (10), and preferably at a point approximately opposite the club head's center of gravity (C.G.). This adds to the stability and integrity of the club head (10) by providing a lower connection point between the hosel (14) and the club head body (12), which decreases the tendency of the club head (10) to twist or turn when a golf ball is struck.

The drawings illustrate a typical mid-iron type of golf club head, such as a five iron, but it will be appreciated that the present description applies equally to the other more or less lofted irons within a typical set of golf club irons. As shown in FIGS. 4 and 5, the centerline (30) of the hosel (14) intersects a plane defined by the ball striking face (22) at an intersection point (33) which projects on the upper half of the ball striking face (22). More preferably, for a typical set of irons having club heads which are approximately 3 to 3½ inches in the heel-to-toe direction, and 2 to 3 inches from the sole-to-top ridge direction, the hosel centerline (30) intersects the ball striking face (22) approximately the same distance along the striking face from the leading edge on all irons, regardless of the loft angle. In one preferred set of irons made according to the present invention, this distance, taken from the leading edge (26) to the intersection point (33) upward along the face (22) of the club head, is 1¼ inches. Preferably, the hosel centerline (30) intersects the extended loft plane of the ball striking face (22) at an intersection point (33) proximate the center of gravity (C.G.) of the club head (10), on or within 0.250 inches of the center of gravity (C.G.).

Figure 2A:
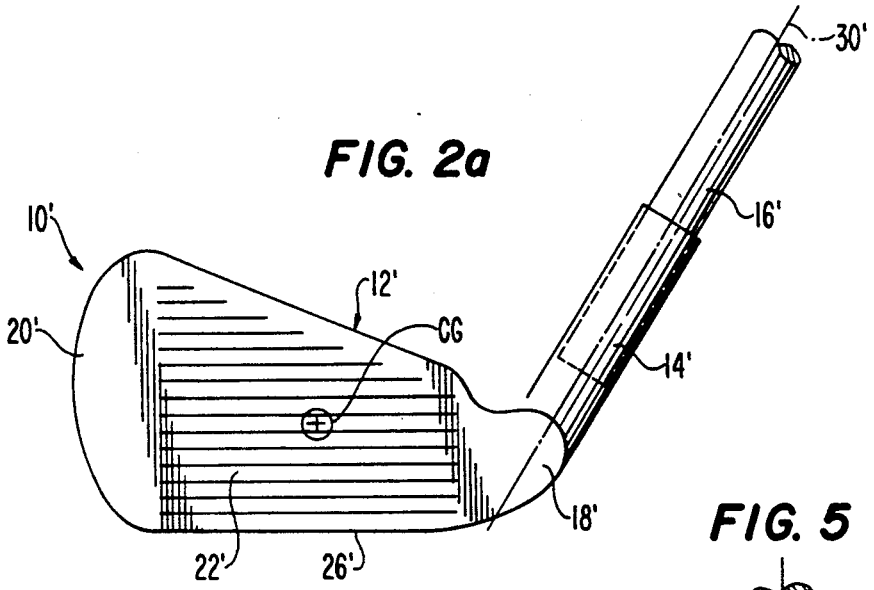
FIG. 2A shows a front elevational view of another embodiment of the present invention.

FIG. 2A illustrates another embodiment of an improved golf club head (10') in accordance with the present invention, and includes a top ridge (12'), a hosel (14'), a shaft (16'), a heel (18'), a toe (20'), a ball striking face (22'), and a leading edge (26'). This embodiment differs from that shown in FIGS. 1 to 5 in that the hosel (14'), is elongated and extends above the top ridge (13') of the golf club head (10') as shown. Typically, the shaft (16') extends well within the hosel as shown in the phantom lines to a point below the top of the toe (20'), and essentially in line with the top ridge (12').

Figure 6:
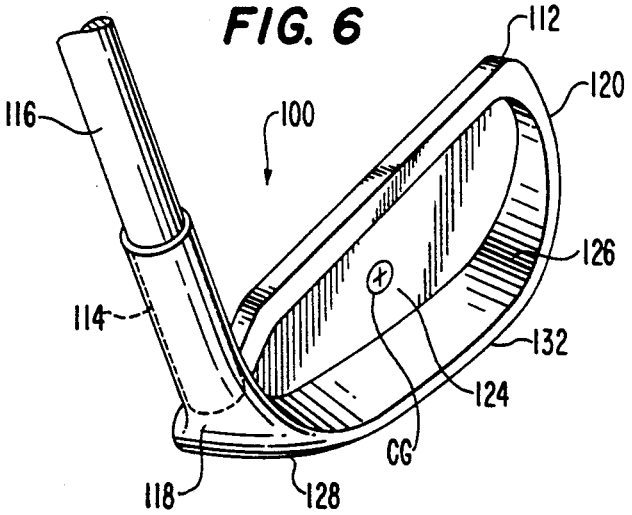
FIG. 6 shows a rear perspective view of a further embodiment of the present invention.

FIG. 6 shows another embodiment of a golf club head (100) of the same type as described hereinabove, wherein the lower portion of the hosel (114) extends to interface with the sole (128) at the heel (118). In this embodiment, the hosel (114) permits the shaft (116) to extend approximately to the sole (128) of the club head (100). The lower end of the connection point of the shaft (116) and hosel (114) is preferably below the center of gravity (C.G.) of the club head (100) and in this embodiment is within 0.250 inches of the sole.

Figure 7A:
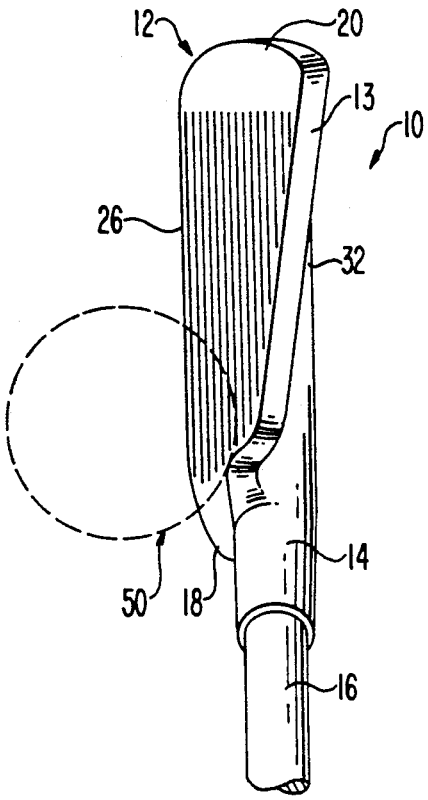
FIG. 7A shows a plan view of the club head of FIG. 1.
Figure 8A:
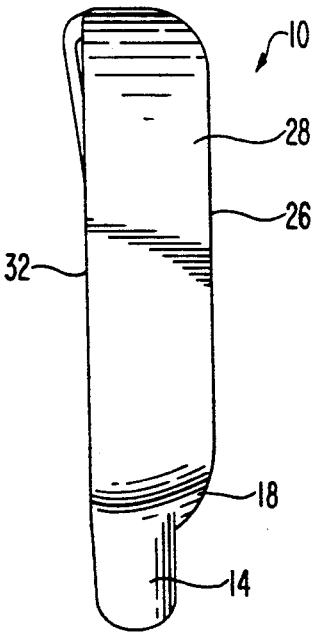
FIG. 8A shows a bottom view of the club head of FIG. 1.
Figure 8B:
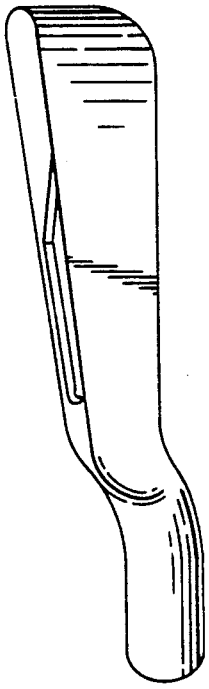
FIG. 8B (PRIOR ART)
FIG. 8B shows a bottom view of the prior art club head of FIG. 7B.
Figure 9A:
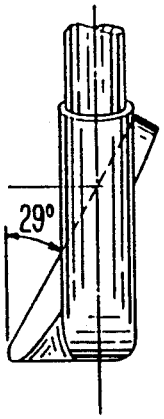
FIGS. 9A and 9B show end views of a typical mid-lofted iron made in accordance with the present invention taken from the hosel and toe end respectively.
Figure 9B:
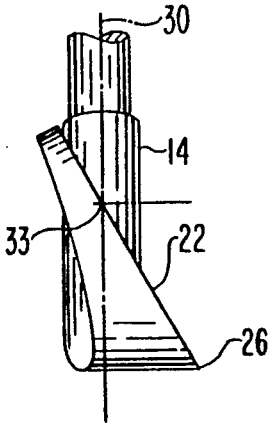
Figure 10A:
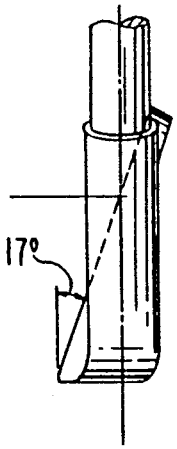
FIGS. 10A and 10B show end views of a typical low-lofted iron made in accordance with the present invention.
Figure 10B:
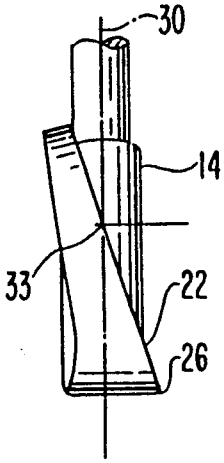
Figure 11A:
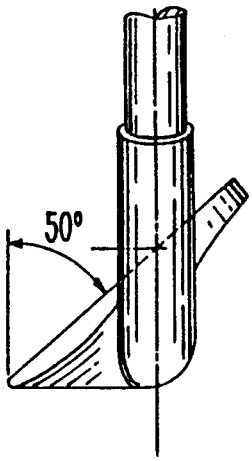
FIGS. 11A and 11B show end views of a typical high-lofted iron made in accordance with the present invention.
Figure 11B:
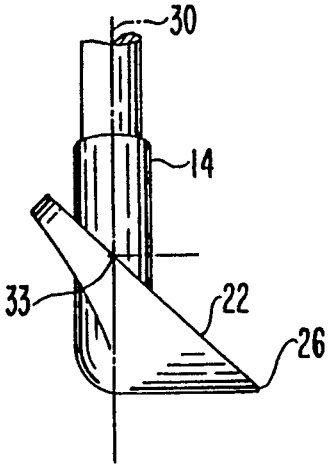
Figure 12A:
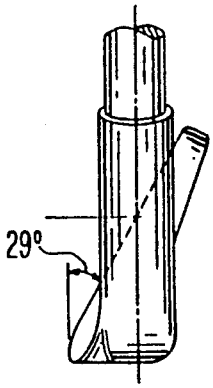
FIGS. 12A and 12B show end views of another typical mid-lofted iron made in accordance with the present invention, taken from the hosel and toe ends, respectively.
Figure 12B:
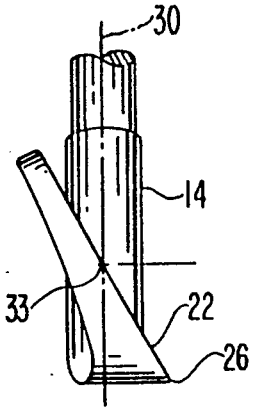
Figure 13A:
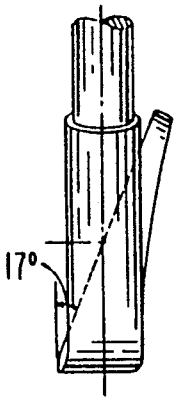
FIGS. 13A and 13B show end views of another typical low-lofted iron made in accordance with the present invention.
Figure 13B:
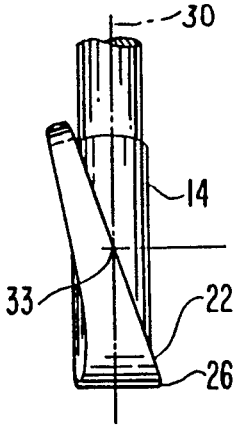
Figure 14A:
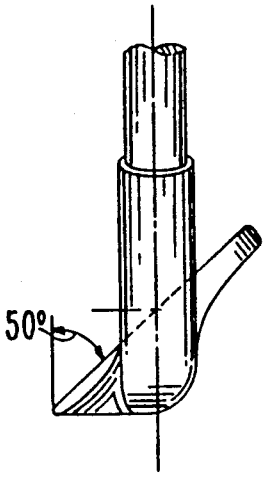
FIGS. 14A and 14B show end views of another typical high-lofted iron made in accordance with the present invention.
Figure 14B:
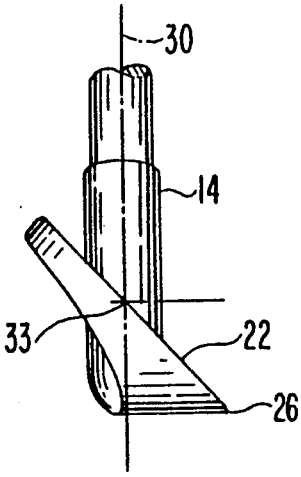

The preferred embodiment of the present invention also provides an improved sighting feature not found in conventional clubs. FIG. 7A shows a top plan view of the golf club (10) of the present invention, as it would appear when positioned by a golfer in the address position prior to the initiation of a golf swing. FIG. 8A shows a bottom view of the golf club (10). As can be seen, the sole (28) of the club head (10) has substantially the same width along its entire length, which contacts the ground surface, so the trailing edge (32) of the club head is essentially parallel with the leading edge (26) and both the leading edge (26) and trailing edge (32) preferably would be perpendicular to the intended line of flight of a golf ball (50) struck by the club head. As shown in FIG. 5 and FIG. 8A, the trailing edge (32) is in substantial alignment with the rear surface of the hosel (14) and smoothly transitions into the hosel. FIG. 8B shows the prior art where the leading edge and trailing edges are not parallel.

With the present invention, the strength and stability of the club head at the heel (18) is substantially improved. The trailing edge (32) is used by the golfer in aligning the club head (10) toward the intended target line by providing a straight line of the trailing edge (32) at the point where normally only the angled top ridge (13) is seen because in the present invention the hosel (14) is positioned well behind the leading edge (26) of the club head (10). It will be appreciated that the lower the loft of the iron, the more of the trailing edge (32) can be seen and used for alignment purposes. This is particularly useful with the low-lofted irons, such as 2, 3, 4 and even 5 irons, which are generally more difficult to hit than the higher lofted irons, such as the 8 and 9 irons and wedges.

Figure 7B:
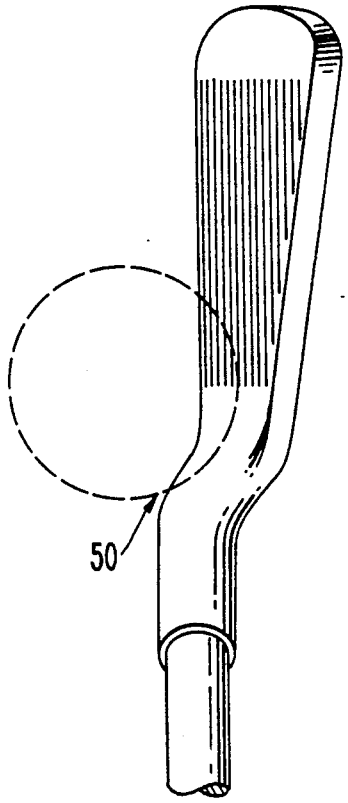
FIG. 7B (PRIOR ART)
FIG. 7B shows a plan view of a prior art golf club head.

FIG. 7A is also used to show the relative position of a golf ball (50) being struck toward the heel or hosel end of the club head, should the club be swung outside of the normal intended club head path. As can be seen, a golf ball (50), shown in phantom, can be hit on the planar surface of the ball striking face (22), without engaging either the hosel (14) or any bridge formed between the hosel and ball striking face, whereas a golf ball struck in the same area on an offset type iron club head will hit the hosel, resulting in a shanked shot, as shown in FIG. 7B.

FIGS. 9A, 9B, 10A, 10B, 11A, and 11B, show irons with low, mid, and high-loft angles, respectively. Each of these irons position the hosel (14) well behind the leading edge (26) of the ball striking face (22) so that any golf balls struck adjacent the heel (18) will not be erratically deflected by the hosel (14), resulting in what is commonly known as a "shanked shot."

As can be seen from FIGS. 9A, 9B, 10A, 10B, 11A, and 11B, the degree of forward face progression in a set of clubs according to the present invention incremently increases with the loft of each iron. For example, the forward face progression is ⅜ of an inch for a low-lofted iron (FIG. 10), ⅝ of an inch for a mid-lofted iron (FIG. 9) and 15/16 of an inch for a high-lofted iron (FIG. 11). It follows that a set of irons made in accordance with the present invention is characterized by a gradually increasing forward face progression from the low-lofted irons to the high-lofted irons. Stated in other words, the distance that the hosel is positioned behind the leading edge of the club head of the set of irons gradually increases as the irons become more lofted, unlike conventional sets of irons, which have rearward face progression or offset configurations. With these golf clubs, the distance between the leading edge (26) and the intersection point (33) of the hosel center line (30) and the ball striking face (22), in all cases, is 1¼ inches.

FIGS. 12A, 12B, 13A, 13B, 14A and 14B show hosel and toe ends respectively of golf club irons made in accordance with the present invention, where the distance between the leading edge (26) and the intersection point (33) of the hosel center line with the ball striking face incremently moves in accordance with the loft of each iron in the set rather than maintaining a constant distance of 1¼ inches as with the clubs described hereinabove. However, in all cases, the hosel center line (30) still intersects the ball striking face (22) proximate the center of gravity and above the lower quadrant of the iron face.

It will be appreciated that the inventive concepts of the present invention are equally applicable to a variety of various types of iron type golf club heads, including cavity back, forged back, muscle back, and others, in keeping with the present invention as defined in the following claims.

In summary, the preferred embodiment of the present invention has a flat, planar face from toe to heel, thereby eliminating the pocket formed between the hosel and face of a conventional club head. The hosel is behind the leading edge of the bal striking face, and the centerline of the hosel intersects with the extended plane of the club face at a point in the middle area or upper half of the club face, more preferably within 0.250 inches of the club head's center of gravity. In a preferred set of clubs, the point of intersection on the club face is approximately 1¼ inches vertically along the ball striking face from the lower leading edge of the club face. The cavity in the hosel for accepting the shaft extends below the highest point of the top ridge of the club head and preferably extends to a point that is approximately aligned with the club head's center of gravity. The leading edge of the club face and the trailing edge of the sole are substantially parallel along the length of the club head which normally contacts the ground from heel to toe, providing improved weighting and stability, along with a sighting feature.

It will be apparent to those skilled in the art that various modifications and variations can be made in the golf club head of the present invention and in construction of this golf club head without departing from the spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I-claim:

1. An iron type golf club head for hitting a golf ball comprising:

a golf club head body having a heel portion, a toe portion, a bottom sole, a top ridge, and a planar, lofted ball striking face extending therebetween, said ball striking face intersecting with a forwardmost progression of said bottom sole to define a leading edge of said club head body, said bottom sole also having a rearwardmost progression defining a trailing edge;

a hosel formed adjacent said heel portion and having a front surface and a rear surface, said trailing edge adjacent the heel portion of said club head body smoothly transitioning into said rear surface of said hosel;

an increased mass formed between the hosel and said bottom sole and defined by the trailing edge at the heel portion to provide additional structural integrity and strength at the heel portion of the club head;

said front surface of said hosel being positioned behind said leading edge of said club head body; and said hose has a centerline extending longitudinally therethrough, said centerline intersecting with an extended loft plane of said ball striking face at a point above a lower quadrant of said ball striking face.

2. The iron type golf club head of claim 1 wherein the trailing edge adjacent the heel portion is substantially in-line with the rear surface of said hosel.

3. The iron type golf club head of claim 1 wherein said leading edge and said trailing edge are substantially parallel to each other and substantially perpendicular to an intended line of flight, along substantially the entire length of the club head.

4. The iron type golf club head of claim 1 wherein the lowermost rear surface of said hosel constitutes the extreme rear lower corner of the club head.

5. An iron type golf club head for hitting a golf ball comprising:

a golf club head body having a heel portion, a toe portion, a bottom sole, a top ridge, and a planar, lofted ball striking face extending therebetween, said ball striking face intersecting with a forwardmost progression of said bottom sole to define a leading edge of said club head body, said bottom sole also having a rearwardmost progression defining a trailing edge;

a hosel formed adjacent said heel portion and having a front surface and a rear surface, said trailing edge of said club head body being substantially aligned with and smoothly transitioning into said rear surface of said hosel;

an increased mass formed at a juncture of said trailing edge and said rear surface of the hosel for additional structural integrity and strength at the heel portion of the club head;

said hose and said ball striking face being formed in a shankproof arrangement, said arrangement being defined by a planar ball striking face extending from said heel portion to said toe portion with said front surface of said hosel being positioned behind said leading edge, thereby preventing the shank portion of said hosel from engaging the golf ball during a golfer's swing; and said hosel has a centerline extending longitudinally therethrough, said centerline intersecting with an extended loft plane of said ball striking face at a point above a lower quadrant of said ball striking face.

6. The iron type golf club head of claim 5 wherein said leading edge and said trailing edge are substantially parallel to each other and substantially perpendicular to an intended line of flight, along substantially the entire length of the club head.

7. The iron type golf club head of claim 5 wherein the lowermost rear surface of said hosel constitutes the extreme rear lower corner of the club head.

8. The iron type golf club head of claim 5 wherein said centerline of said hosel intersects with said extended loft plane of said ball striking face within 0.250 inches of the club head's center of gravity.

9. The iron type golf club head of claim 5 wherein said centerline intersects with said extended loft plane substantially at the proximate area of said club head's center of gravity.

10. The iron type golf club head of claim 5 wherein said centerline of said hosel intersects with said extended loft plane of said ball striking face above the club head's center of gravity.

11. The iron type golf club head of claim 5 wherein said centerline of said hosel intersects with said extended loft plane of said ball striking face below the club head's center of gravity.

12. The iron type golf club head of claim 5 wherein said hosel includes a shaft socket for receiving a club shaft, said shaft socket having a bottom surface located below a highest point of said top ridge.

13. The iron type golf club head of claim 12 wherein said bottom surface of said shaft socket extends below a lowest point of said top ridge.

14. The iron type golf club head of claim 12 wherein said bottom surface of said shaft socket is approximately level with the club head's center of gravity.

15. An iron type golf club head for hitting a golf ball, comprising:

a golf club head body having a heel portion, a toe portion, a bottom sole, a top ridge and a planar lofted ball striking face extending therebetween, said ball striking face intersecting with a forwardmost progression of said bottom sole to define a leading edge of said club head body, said bottom sole also having a rearwardmost progression defining a trailing edge;

a hosel formed adjacent said heel portion and having a front surface and a rear surface, said hosel having a shaft socket for receiving a club shaft, said socket having a lower surface extending below the highest point of said top ridge;

said hosel and said ball striking face being formed in a shankproof arrangement, said arrangement being defined by a planar ball striking face extending from said heel portion to said toe portion with said front surface of said hosel being positioned behind said ball striking face, thereby preventing said hosel from engaging the golf ball during a golfer's swing; and said hosel has a centerline extending longitudinally therethrough, said centerline intersecting with an extended loft plane of said ball striking face at a point above a lower quadrant of said ball striking face.

16. The iron type golf club head of claim 15 wherein said bottom surface of said shaft socket extends below a lowest point of said top ridge.

17. The iron type golf club head of claim 15 wherein said bottom surface of said shaft socket is approximately level with the proximate area of the club's head center of gravity.

* * * * *